United States Patent [19]

Hippely et al.

[11] Patent Number: 4,516,953

[45] Date of Patent: May 14, 1985

[54] TOY VEHICULAR PLAYSET

[75] Inventors: Keith A. Hippely, Manhattan Beach; Samuel M. Goldstein, Los Angeles, both of Calif.

[73] Assignee: Mattel, Inc., Hawthorne, Calif.

[21] Appl. No.: 565,558

[22] Filed: Dec. 27, 1983

[51] Int. Cl.[3] ..... A63H 18/00

[52] U.S. Cl. ..... 446/444; 238/10 E

[58] Field of Search ..... 46/202, 1 K, 206, 201, 46/251; 238/10 R, 10 A, 10 E, 10 F; D21/143; 446/444, 445, 446, 168, 170

[56] References Cited

U.S. PATENT DOCUMENTS

| | | | |
|---|---|---|---|
| D. 202,053 | 8/1965 | Montagna | D34/15 |
| 3,677,469 | 7/1972 | Edmisson et al. | 238/10 E |
| 3,696,557 | 10/1972 | Ruggel | 46/243 M |
| 3,712,538 | 1/1973 | Starr et al. | 46/1 K X |
| 4,146,991 | 4/1979 | Sano | 46/202 |
| 4,251,949 | 2/1981 | Buck et al. | 46/202 |
| 4,285,157 | 8/1981 | Lambert | 46/202 |

FOREIGN PATENT DOCUMENTS

| | | | |
|---|---|---|---|
| 926114 | 3/1955 | Fed. Rep. of Germany | 446/469 |

*Primary Examiner*—Mickey Yu

*Attorney, Agent, or Firm*—Ronald M. Goldman; James G. O'Neill

[57] ABSTRACT

A toy vehicular playset having a transparent hollow member with two open ends. A toy vehicular track formed integrally with the inner surface of the hollow member. The track spiraling from one open end to the other open end. A portion of the track is wider than that of the remainder of the track. Two toy vehicles, each having a wheel-and-axle assembly which is affixed to steer the respective vehicle to the same side of the track whereby one of the vehicle may be caused to enter one end of the hollow member and the other vehicle may be caused to enter the other end of the hollow member in a manner such that the two vehicles will meet and pass each other at the widened track portion without touching each other.

6 Claims, 4 Drawing Figures

TOY VEHICULAR PLAYSET

TECHNICAL FIELD

The present invention relates to playsets for toy vehicles and, more particularly, to a new and useful barrel run for toy vehicles.

BACKGROUND ART

The prior art, U.S. Pat. No. Des. 202,053, discloses an ornamental design for a loop track for toy vehicles.

Additionally, U.S. Pat. No. 3,677,469 discloses an accessory for a track system useable with toy wheeled vehicles which serves to change the direction of travel of vehicles traversing the track while at the same time causing the vehicles to travel through an essentially vertical loop. The track system utilizes well-known linear sections of elongated flexible track and includes a loop-turn fixture having track securing members which serve to secure the track to the loop-turn fixture.

U.S. Pat. No. 3,696,557 discloses a self-propelled toy including a hollow shell and a battery-operated motor which is enclosed within the shell for causing the shell to roll along a supporting surface. A gravity-operated switch is mounted on the motor for de-energizing the motor when the toy is not in use. In operation, the motor is disposed at a lowermost portion of the shell, and the switch is disposed in a position to energize the motor for causing the shell to revolve about the motor. When the shell becomes restrained from movement, the motor moves relative to the shell along the inner surface thereof until the switch reaches a position where it opens the circuit to the motor.

U.S. Pat. No. 4,146,991 discloses a toy trackway featuring a platform having an upper level and a lower level; the upper level is provided with a trackway terminating at each end in a locking member, and the lower level is provided with two trackways, each terminating in a locking member. Two flexible trackways each terminate in locking members for engagement with the locking members of the trackways on the upper and lower levels of the platform, thus permitting one of the locking members of each of the flexible trackways to be attached to the locking members of the trackway of the upper level and the other of the locking members of each of the flexible trackways to be attached to the locking members of the trackways of the lower level either on the same side of the platform or on opposite sides of the platform.

U.S. Pat. No. 4,251,949 discloses a toy racing apparatus including an inclined section of track and a bowl. The track enters the bowl through an opening in the lower sidewall where its surface is tangent to the interior wall. A vehicle placed at the upper end of the track will speed down the track, enter the bowl and progress in a spiral path upwardly inside the bowl. In a preferred embodiment, the bowl is transparent and flags are positioned to be displaced as a vehicle reaches particular heights in the bowl.

U.S. Pat. No. 4,285,157 discloses a toy racing set including at least one powered vehicle, a length of flexible track and a carrying case. The carrying case folds out to form a track upon which the vehicle may run. The case may also be used when closed with the flexible track to provide a loop-the-loop track for a powered vehicle.

DISCLOSURE OF INVENTION

In accordance with the present invention, a new and useful toy vehicular playset is provided. The playset includes a hollow member having an encompassing sidewall, a first open end and a second open end. The encompassing sidewall includes an inner surface and an outer surface. A toy vehicular track is provided on the inner surface of the sidewall with the track spiraling from one open end to the other, whereby a toy vehicle may be guided along the inner surface of the sidewall from one open end to the other.

The vehicular track may be provided with an intermediate portion of sufficient width to permit two cars to be started simultaneously from either end of the hollow member and then pass without touching in the middle of the hollow member.

The playset may also include a pair of toy vehicles having their front axle-wheel assemblies biased to one side so that the vehicles will tend to stay on one side of the track inside the hollow member while passing each other at the center of the hollow member.

BRIEF DESCRIPTION OF THE DRAWINGS

Details of the present invention will be described in connection with the accompanying drawings wherein.

BEST MODE FOR CARRYING OUT THE INVENTION

Figure 1:
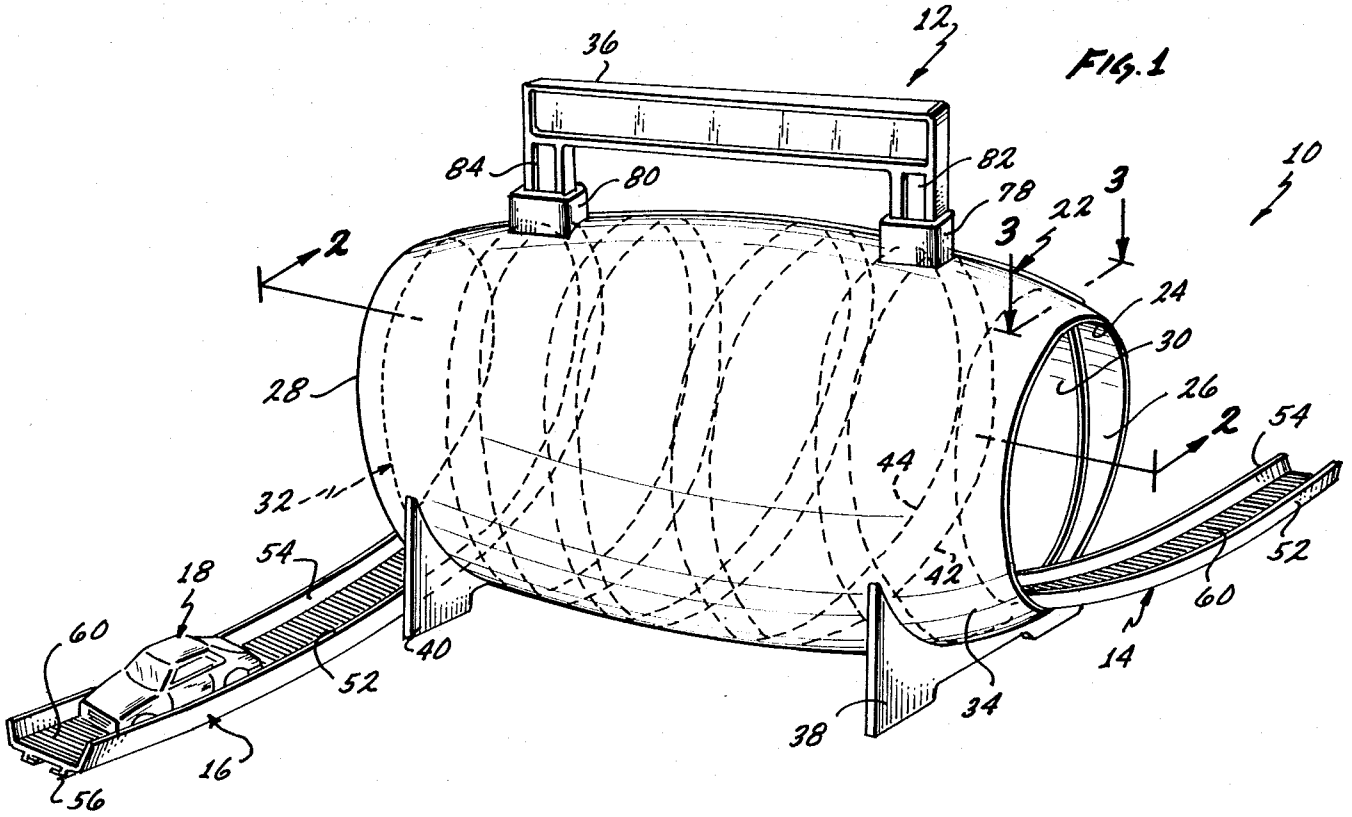
FIG. 1 is a perspective view of a toy vehicular playset of the present invention.

Referring again to the drawings, a toy vehicular playset constituting a presently-preferred embodiment of the invention, generally designated 10, includes a barrel run 12, an entrance track 14, an exit track 16 and a pair of toy vehicles 18, 20.

Barrel run 12 includes a hollow member 22 having an encompassing sidewall 24, a first open end 26 and a second open end 28. Sidewall 24 includes an inner surface 30, upon which a vehicular track 22 is provided, and an outer surface 34, to which a carrying handle 36 and support brackets or legs 38 and 40 are affixed.

Figure 2:
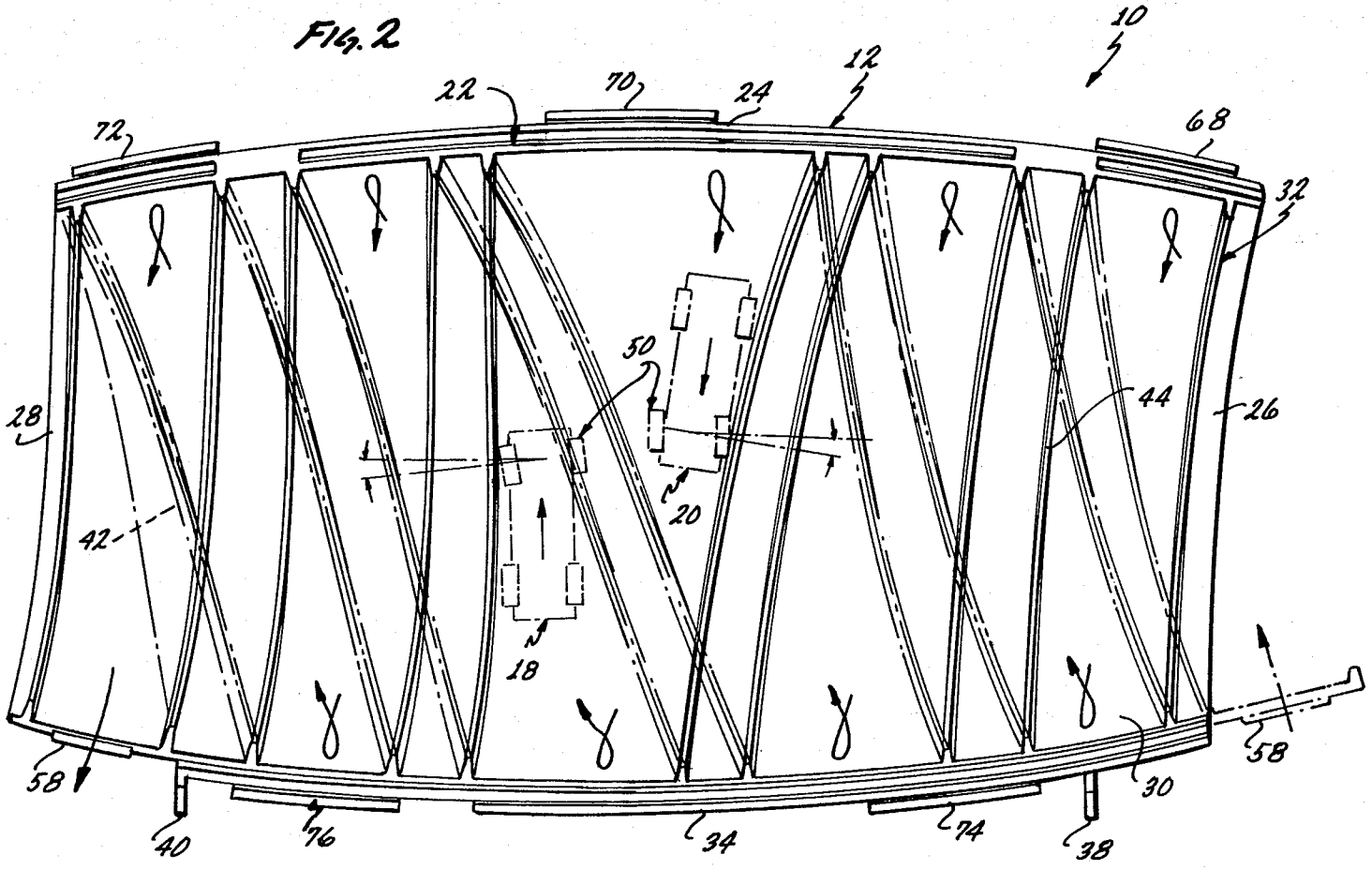
FIG. 2 is an enlarged cross-sectional view taken along line 2—2 of FIG. 1.

Track 32 includes first and second raised ribs 42, 44 respectively, spiraling from entrance or open end 26 to exit or open end 28 in spaced-apart relation. The distance between ribs 42, 44 at the mid-portion of hollow member 22 is great enough so that vehicles 18, 20 may meet and pass without touching each other, as shown in FIG. 2. Ribs 42, 44 serve as guide members for vehicles 18, 20, each of which has its front axle-wheel assembly 50 canted about 1–5 degrees out of parallel with the rear wheel and axle assembly so that each vehicle will ride against its associated rib to assure that the vehicles will pass each other at the center of hollow member 22 without colliding with each other. Ribs 42, 44 may be formed integrally with hollow member 22 during the molding thereof from a suitable polymeric material.

Figure 3:
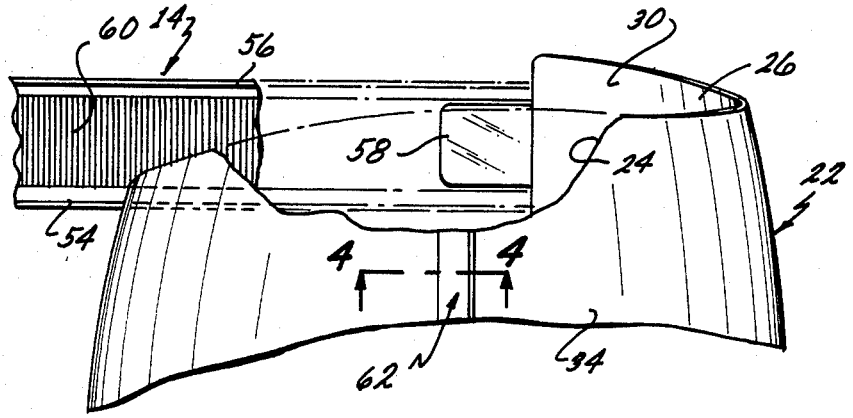
FIG. 3 is an enlarged, partial plan view taken in the direction of line 3—3 of FIG. 1 and having parts broken away to show internal construction.

Tracks 14, 16 may each be extruded from a suitable polymeric material to provide a pair of spaced-apart upstanding sidewalls 52, 54 and a depending channel 56. Channel 56 facilitates connecting tracks 14, 16 to barrel run 12 by engaging a suitable track connector, like the one shown at 58 in FIG. 3. The upper surfaces of tracks 14, 16 may be provided with serations 60 for increasing the traction between vehicles 18, 20 and track section 14, 16 so that the vehicles may enter hollow member 22 at a sufficient rate of speed.

Figure 4:
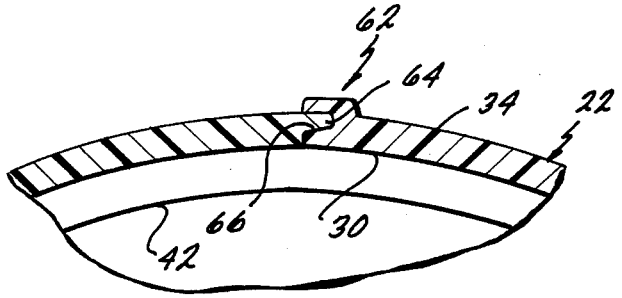
FIG. 4 is an enlarged cross-sectional view taken along line 4—4 of FIG. 3.

Barrel run 12 may be molded in two halves from K resin or butedienstyrene. The inside edges of the two halves may be maintained in alignment by a lap joint of the type shown at 62 in FIG. 4, wherein a longitudinal tongue 64 engages a longitudinal slot 66. The two halves are preferrably substantially transparent to permit a child-user to view vehicles 18, 20 as they travel through the hollow member 22. As best seen in FIG. 2, each half of hollow member 22 is provided with a plurality of snap fasteners 68, 70, 72, 74 and 76 adapted to engage complimentary snap fasteners on the other mold half and firmly lock the two halves together. The front half of hollow member 22 (FIGS. 1, 2) is provided with a pair of sockets 78, 80 adapted to receive the legs 82, 84, respectively, on carrying handle 36.

Operation of toy vehicular playset 10 is believed to be apparent from the foregoing and will be briefly summarized at this point. A child-user may energize vehicle 18 through its internal spring motor, or the like (not shown), and then place car 18 on entrance track 14 with vehicle 18 headed in the direction of opening 26. Vehicle 18 will then engage the first raised rib 42 and be guided in a spiral path from open end 26 to the second open end or exit 28, whereupon vehicle 18 will exit from hollow member 22 on the exit track 16.

The child-user may also energize vehicles 18, 20 simultaneously with vehicle 18 entering hollow member 22 on entrance track 14 and vehicle 20 entering hollow member 22 on exit track 16. Vehicle 20 will be guided to the entrance end 26 by the second raised rib 44 while vehicle 18 is being guided to the exit end 28 by the first raised rib 42. When vehicles 18, 20 reach the approximate mid-portion of hollow member 22, they will pass each other, as shown in FIG. 2, and continue to the second open end or exit 28 and the first open end or entrance 26, respectively.

While the particular toy vehicular playset herein shown and described in detail is fully capable of obtaining the objects and providing the advantages hereinbefore stated, it is to be understood that it is merely illustrative of the presently-preferred embodiment of the invention and that no limitations are intended to the details of the construction or design herein shown other than as defined in the appended claims.

We claim:

1. In a toy vehicular playset, the combination comprising:

a transparent hollow member having an encompassing sidewall, a first open end and a second open end, said encompassing sidewall including an inner surface and an outer surface; and a toy vehicular track formed integrally with said inner surface of said sidewall, said track spiraling from one of said open ends of said hollow member to the other end thereof, whereby toy vehicles may be guided along said inner surface of said sidewall from either one of said open ends to the other of said open ends.

2. The combination recited in claim 1 including a pair of vehicular track sections and means for connecting said pair of vehicular track sections to said first and second open ends for guiding toy vehicles into and out of said hollow member.

3. The combination recited in claim 1 wherein said track formed integrally with said inner surface includes a portion wider than that of the remainder of said track and of sufficient width to accommodate two toy vehicles in side-by-side relation.

4. The combination recited in claim 1 including a first toy vehicle adapted to traverse said track means, said first toy vehicle having a wheel-and-axle assembly which is affixed to said first toy vehicle in a manner such that said first toy vehicle is steered to a predetermined side of said track means.

5. The combination recited in claim 3 including at least two toy vehicles adapted to traverse said track on said inner surface, each of said two toy vehicles having a wheel-and-axle assembly which is affixed to its associated vehicle in a manner such that said associated vehicle is steered to the same side of said track means, whereby one of said two toy vehicles may be caused to enter one end of said hollow member and the other of said two toy vehicles may be caused to enter the other end of said hollow member in a manner such that said two toy vehicles will meet and pass each other at said widened track portion without touching each other.

6. In a toy vehicular playset, the combination comprising:

a hollow member made from a transparent material, said hollow member having an encompassing sidewall, a first open end and a second open end, said encompassing sidewall including an inner surface and an outer surface;

an interior track formed integrally with said inner surface of said sidewall and being viewable from the exterior thereof, said interior track spiraling from one of said open ends of said hollow member to the other end thereof, and including a portion substantially at the midpoint of said hollow member which is wider than that of the remainder of said interior track;

a pair of vehicular track sections connected to means formed at said first and second ends of said hollow member for guiding toy vehicles into and out of said interior track in said hollow member;

a pair of toy vehicles adapted to traverse said track, each of said pair of toy vehicles having a wheel-and-axle assembly which is affixed to its associated vehicle in a manner such that when said associated vehicle is riding on said interior track it is steered to a predetermined side of said interior track, whereby one of said pair of toy vehicles may be caused to enter one end of said hollow member and the other of said pair of toy vehicles may be caused to enter the other end of said hollow member in a manner such that said two toy vehicles will meet and pass each other at said widened interior track portion without touching each other; and a handle means attached to the outer surface of said hollow member to allow said hollow member to be easily transported by a user.

* * * * *